US009925414B2

(12) United States Patent
Letow

(10) Patent No.: US 9,925,414 B2
(45) Date of Patent: Mar. 27, 2018

(54) TRAINING APPARATUS FOR THE TRUNK MUSCULATURE

(71) Applicant: Nikolai Letow, Dresden (DE)

(72) Inventor: Nikolai Letow, Dresden (DE)

( * ) Notice: Subject to any disclaimer, the term of this patent is extended or adjusted under 35 U.S.C. 154(b) by 119 days.

(21) Appl. No.: 14/380,940

(22) PCT Filed: Nov. 1, 2012

(86) PCT No.: PCT/EP2012/071647
§ 371 (c)(1),
(2) Date: Aug. 26, 2014

(87) PCT Pub. No.: WO2013/064589
PCT Pub. Date: May 10, 2013

(65) Prior Publication Data

US 2015/0251050 A1 Sep. 10, 2015

(30) Foreign Application Priority Data

Nov. 2, 2011 (DE) ..... 10 2011 085 571
Nov. 2, 2011 (DE) ..... 20 2011 051 836 U
Apr. 2, 2012 (DE) ..... 20 2012 101 188 U

(51) Int. Cl.
*A63B 23/02* (2006.01)
*A63B 21/00* (2006.01)

(52) U.S. Cl.
CPC ..... *A63B 23/0222* (2013.01); *A63B 21/4011* (2015.10); *A63B 23/0205* (2013.01);
(Continued)

(58) Field of Classification Search
CPC ..... A63B 2208/0233
See application file for complete search history.

(56) References Cited

U.S. PATENT DOCUMENTS 4,669,451 A * 6/1987 Blauth ..... A61F 5/013 482/901
6,113,522 A 9/2000 Fontenot et al.
(Continued)

FOREIGN PATENT DOCUMENTS

AT 506525 A2 9/2009
DE 19915003 A1 10/2000
(Continued)

*Primary Examiner* — Loan H Thanh
*Assistant Examiner* — Rae Fischer
(74) *Attorney, Agent, or Firm* — Michael Soderman

(57) ABSTRACT

This invention relates to training apparatuses for the trunk musculature. The training apparatuses are characterized in particular in that the spinal erectors and the abdominal muscles can be trained. To this end, a frame has a sitting device with a seat for unrestrained sitting without contact with the floor, at least one backrest, a first fixing device for the pelvis, and at least one second fixing device for an arm or a hand. Furthermore, the seat including the coupled first fixing device is movable relative to the backrest including the second fixing device. The movable seat including the first fixing device and the backrest including the second fixing device advantageously result in the pelvis being movable while the upper body remains steady. The frame is configured so that the feet or the legs cannot support the upper body.

7 Claims, 5 Drawing Sheets

(52) U.S. Cl.
CPC ..... *A63B 23/0211* (2013.01); *A63B 23/0233* (2013.01); *A63B 2208/0228* (2013.01)

(56) References Cited

U.S. PATENT DOCUMENTS

| | | | | | |
|---|---|---|---|---|---|
| 6,652,430 | B2 * | 11/2003 | Lapcevic | ..... | A63B 21/0552 482/133 |
| 7,357,765 | B1 | 4/2008 | Watson | | |
| 7,867,149 | B1 | 1/2011 | Webber | | |
| 2008/0096742 | A1 | 4/2008 | Garner | | |

FOREIGN PATENT DOCUMENTS

| | | | | | |
|---|---|---|---|---|---|
| DE | 20207978 | U1 | 11/2002 | | |
| DE | 102007045893 | A1 | 4/2008 | | |
| WO | 0114017 | A1 | 3/2001 | | |
| WO | WO/2001/014017 | * | 3/2001 | ..... | A63B 21/058 |

* cited by examiner

TRAINING APPARATUS FOR THE TRUNK MUSCULATURE

CROSS REFERENCE TO RELATED APPLICATIONS

This application is the U.S. national stage of International Application No. PCT/EP2012/071647 filed on Nov. 1, 2012, and claims the benefit thereof. The international application claims the benefit under 35 USC 119 of German Application Nos. DE 102011085571.8 filed on Nov. 2, 2011; DE 202011051836.1 filed on Nov. 2, 2011; and DE 202012101188.3 filed on Apr. 2, 2012; all applications are incorporated by reference herein in their entirety.

BACKGROUND

The invention relates to training apparatus for the trunk musculature. Training apparatus for the most diverse areas and musculatures of the human body are known from the most diverse publications.

A training apparatus for the trunk musculature is known from the document DE 94 05 749 U1. The apparatus consists of a structure with a floor stand, a support frame, an air-filled ball and positioning devices for the legs and the lower body for training the trunk musculature. The air-filled ball supports the weight of the upper body when the person is on his or her back, in prone position or on his or her side. The positioning device arranged at the opposite end of the floor stand holds the feet, the lower legs or the knees of the exercising person in place, depending on the type of exercise. The knees, the thighs or the pelvis rest on the support arranged in the middle.

The person has to lift his or her upper body from the air-filled ball and lower it down on the ball again to train the trunk musculature. Twisting of the body during use cannot be ruled out. Individual muscles and special muscles of the trunk musculature cannot be easily trained.

DETAILED DESCRIPTION

The invention specified in claim 1 is based on the problem of creating a training apparatus for the erector spinae, the abdominal muscles and the lateral trunk musculature.

This problem is solved with the features specified in claim 1.

The training apparatus for the trunk musculature especially distinguishes itself by the fact that the erector spinae and the abdominal muscles can be trained.

To this end, a stand has a place to sit with a seat for unrestrained sitting without contact with the floor, at least one back, a first positioning device for the pelvis and at least one second positioning device for an arm or a hand. Furthermore, the seat with a coupled first positioning device can be moved vis-a-vis the back with the second positioning device.

The movable seat with the first positioning device and the back with the second positioning device advantageously lead to the pelvis being capable of movement with an upper body that is fixed in place. The stand is designed in such a way here that the feet or legs cannot support the upper body. The user of the training apparatus sits in an unrestrained way and thereby without contact with the floor on the place to sit. The floor means, in particular, the floor space for the training apparatus here.

The erector spinae, the inner oblique abdominal muscles, the outer oblique abdominal muscles, the straight abdominal muscle and/or the transverse abdominal muscles are therefore advantageously worked in the movement, depending on the position of the user of the training apparatus.

But footrests, as an example, in the form of support areas for the feet are also not ruled out, of course. The footrest(s) is/are coupled to the seat for this.

The pelvis is advantageously moved in the process. The positioning device and the position of the user lead to a situation in which only the respective muscles of the trunk musculature are specifically capable of being trained. In particular, the upper body remains in a relaxed position. The reluctance to use this is therefore reduced, especially for unfit people or older people. This does not rule out training for fit people, of course. The training apparatus can also be used in rehabilitation.

Advantageous design forms of the invention are specified in further embodiments.

According to a further embodiment, the first positioning device is

- a positioning device for at least one leg connected to the pelvis, so the force in the longitudinal direction of the thigh bone is transferred to the pelvis,
- a pair of lateral seat bolsters or
- a rear seat bolster.

The pelvis is therefore fixed in place on the seat. Frontward and backward movements of the pelvis can be done vis-a-vis the back with the positioning devices for the leg and the rear seat bolster, and lateral movements of the pelvis can be done with the lateral seat bolsters.

According to another embodiment, the seat is either capable of movement in a guided fashion vis-a-vis the back or a component of a pendulum. In the latter case, it is a type of swing.

The place to sit, according to a further embodiment, is connected to the stand via at least one swivel joint and can be locked in place in various positions, so the place to sit can be tilted vis-a-vis the floor space. The tilt of the place to sit can therefore be adjusted, so the height of the load on the respective muscles can be chosen in a simple way. In so doing, the tilt determines the amount of force required to move the seat vis-a-vis the back.

According to a further embodiment, at least one swivel joint that can be fixed in place is located between the stand and the place to sit, so the place to sit can be tilted vis-a-vis the floor space and can be fixed in place in various positions. The height of the load on the respective muscles can therefore be chosen in a simple way. In so doing, the tilt determines the amount of force required to move the seat vis-a-vis the back. As an example, the user can therefore choose a vertical position, a tilted position or a horizontal position vis-a-vis the floor space.

According to another embodiment, a hand-operated or driven gearbox for tilting the place to sit is arranged between the place to sit and the stand. The tilt can be easily changed with that. That takes place by hand, for instance via a crank, or by means of a motor.

The gearbox is, according to a further embodiment, a self-locking worm gear pair or a gear drive having a latch. The place to sit can be simply fixed in place in various positions with that.

The stand and the place to sit are coupled to a locking brake according to another embodiment.

They can be connected via a pulling medium to a brake lever or coupled to a drive unit for this. The brake can be locked or released by actuating the brake lever or activating the drive unit. The brake lever is advantageously arranged in such a way for this that it can be manually actuated by the user while in position on the training apparatus.

Furthermore, the locking brake can have at least one pawl and at least one detent mechanism for the pawl so that the pawl is automatically released from the detent mechanism when the locking brake is released. The detent mechanism and the pawl ensure a fixed position of the place to sit, so the user can be safely seated and can safely leave the training apparatus.

According to a further embodiment, the guideway of the seat with the first positioning device is comprised of a straight guideway or a curved guideway made up of at least one guide element and at least one guided element coupled to it; the guideway is a sliding or roller guideway. That is a guideway for the seat that is simple and that can be economically manufactured. At the same time, this ensures that the seat and therefore the user, especially his or her pelvis, are securely held in place.

Furthermore, the guide element and the back are arranged so as to be at an angle to each another and are connected or coupled to one another. Moreover, the guided element is the seat or a support for the seat.

The first positioning device has, according to a further embodiment, an L or T shape. The first positioning device is further coupled to the seat via at least one guideway. Additionally, the first positioning device can be arranged in various positions vis-a-vis the seat via a locking mechanism. A secure and fixed position of the user and therefore of his or her pelvis on the seat are therefore ensured.

According to another embodiment, the first positioning device advantageously has support elements for the knee and/or the lower legs. Force transfer for the abdominal muscles therefore advantageously exists. Further, the training apparatus can be used in a health-preserving way.

The back is, according to a further embodiment, a backrest, an armrest or a rest for the front part of the upper body.

According to another embodiment, the back can be adjusted in terms of its height vis-a-vis the seat and can be locked in place in various positions. An adjustment for the respective body size of the user is therefore easy.

The second positioning device, according to a further embodiment, is advantageously a handgrip on the back.

According to a further embodiment, the place to sit has a fastening device for at least one body with weight. The intensity of the training can be increased with that.

BRIEF DESCRIPTION OF THE DRAWINGS

An example of the invention is shown in the drawings in the form of its basic structure in each case, and it will be described in more detail below.

The following are shown in the figures.

DETAILED DESCRIPTION OF THE PREFERRED EMBODIMENT

A training apparatus for the trunk musculature is essentially comprised of a stand 1 and a place to sit 2.

Figure 1:
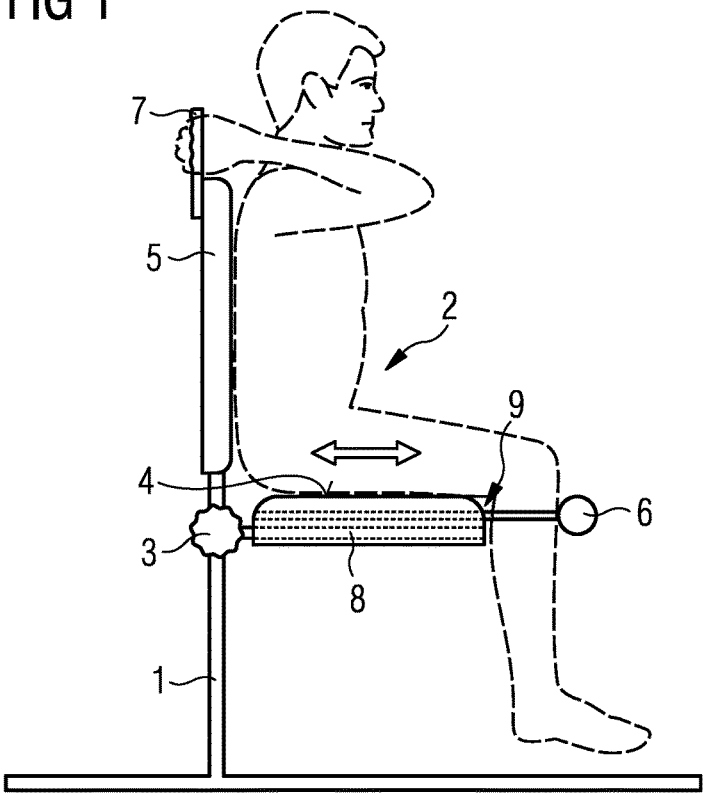
FIG. 1 shows a training apparatus for the trunk musculature in a side view.
Figure 2:
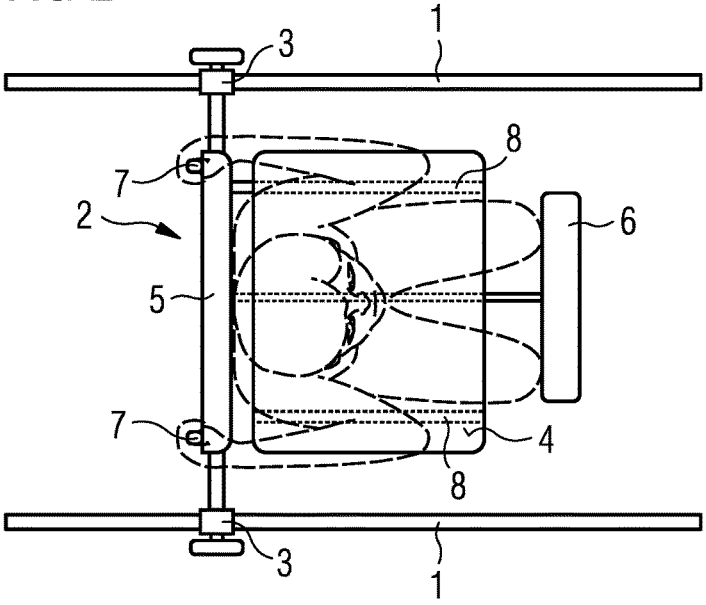
FIG. 2 shows a training apparatus for the trunk musculature in a top view.

FIG. 1 shows a training apparatus for the trunk musculature in an elementary side view for this, and FIG. 2 shows a training apparatus for the trunk musculature in an elementary top view.

The stand 1 is a base with two stand elements in a T shape. The place to sit 2 is arranged on the base and between the stand elements in a swiveling fashion via two swivel joints 3. The place to sit 2 can be locked in place in various positions by means of at least one locking mechanism. The place to sit 2 can be tilted vis-a-vis the floor space when the locking mechanism is released. At least one hand-operated or driven gearbox is located between the place to sit 2 and the stand 1 for that. As an example, a self-locking worm gear pair or a gear drive having a latch is used for that. Operation is advantageously done by means of a crank.

The place to sit 2 is essentially comprised of a seat 4 for unrestrained sitting without contact with the floor, a back 5, a first positioning device 6 for the legs and second positioning devices 7 for the hands. The back 5 is a backrest 5.

The second positioning devices 7 are grips 7 for the hands.

The seat 4 with the first positioning device 6 coupled to it can be moved in a guided fashion vis-a-vis the back 5. The guideway 8 of the seat 4 with the first positioning device 6 is comprised of a straight guideway made up of two guide elements 12 that are arranged in parallel to one another and that are connected to the back 5, and at least two elements coupled to that in a guided fashion and connected to the seat 4. The guideways 8 can be designed to be straight sliding or roller guideways here.

The first positioning device 6 has a T shape in a top view; the crossbeam formed there is arranged so as to be parallel to the back 5 and the seat 4. The knees of the user will therefore be fixed in place when the seat 4 is returned vis-a-vis the back 5. This first positioning device 6 is coupled to the seat 4 via at least one further guideway 9 for this and can be placed in various positions vis-a-vis the seat 4 by means of a locking mechanism. The further guideway 9 is designed to be telescoping, for instance. The guided component as part of the first positioning device 6 can be fixed in place, for example, via a known clamping or ratcheting mechanism so as to be capable of being released. The former is a cam for instance. The first positioning device 6 advantageously has support elements for the knees, so the training apparatus can be comfortably used.

In a further embodiment, the stand 1 is a base with two stand elements in a T or U shape. The place to sit 2 is arranged on the base and between the stand elements in a rotatable fashion via two swivel joints 3. The place to sit 2 can be locked in place in various positions by means of at least one locking mechanism. The place to sit 2 can be tilted vis-a-vis the floor space when the locking mechanism is released.

In a first form, the stand 1 or the place to sit 2 has a plate with openings arranged at a distance to one another on at least one area of a circular path. Furthermore, the place to sit 2 or the stand 1 has a latch or a retaining pin to engage in a releasable fashion in one of the openings. The latch or retaining pin is a hand or machine-operated latch or a hand or machine-operated retaining pin.

In a second form, the stand 1 and the place to sit 2 are coupled to a locking brake for this that is connected to a brake lever via a pulling medium; the pulling medium is designed to be a cable, for instance. The locking brake has at least one pawl and at least one detent mechanism for the pawl so that the pawl is automatically released from the detent mechanism when the locking brake is released. The pawl and the detent mechanism are designed in such a way that the pawl can be released with a force that acts against the normal force.

In a third form, the training apparatus has the features of the first and second forms as a combination.

Figure 3:
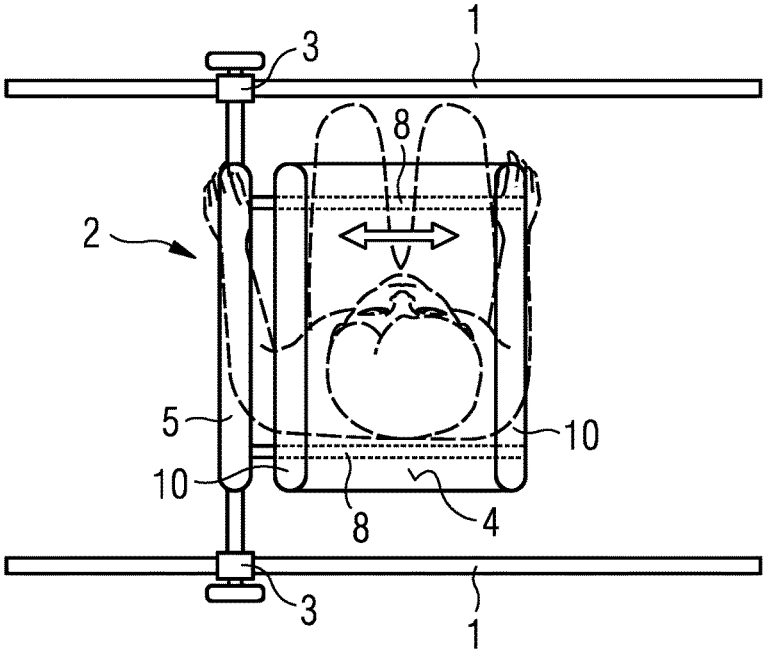
FIG. 3 shows a training apparatus with an armrest in a top view.

FIG. 3 shows a training apparatus with an armrest 5 in an elementary top view.

In one embodiment, the back 5 is at least an armrest 5, preferably two armrests 5. FIG. 3 shows only one armrest 5. The second positioning device 7 is coupled at a right angle to the armrest 5 on the seat 4. The seat 4 has two lateral seat bolsters 10 as the first positioning device 6 so that the pelvis of the user is fixed in place on the seat 4.

Figure 4:
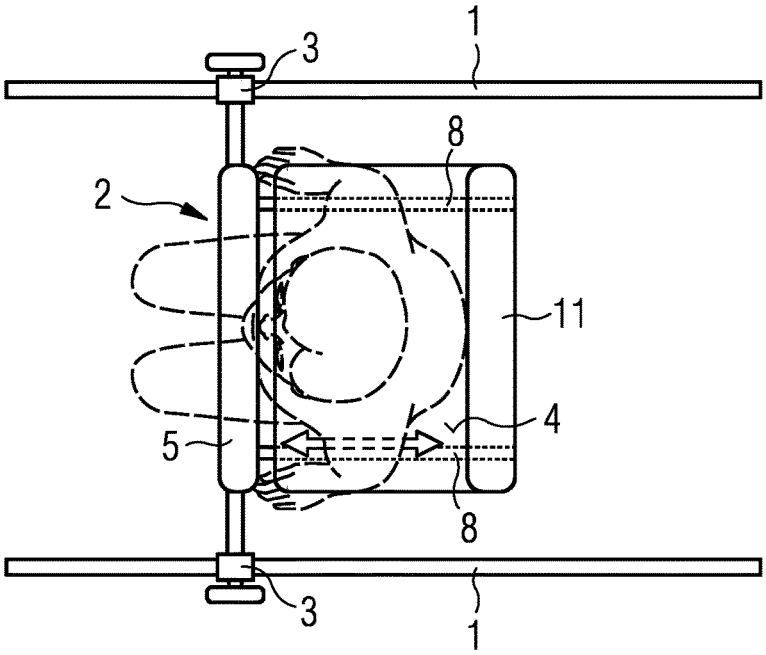
FIG. 4 shows a training apparatus with a rest for the front area of the upper body in a top view.
Figure 5:
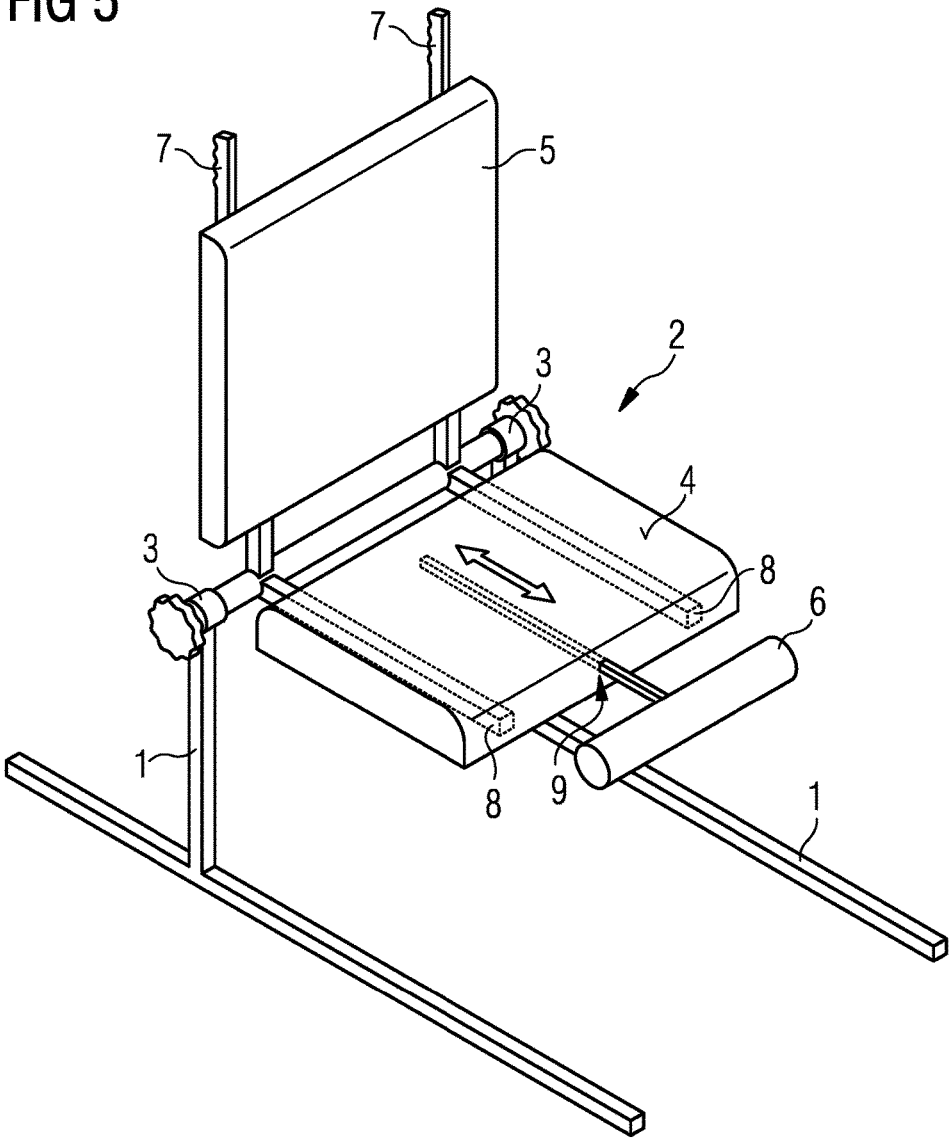
FIG. 5 shows a training apparatus for the trunk musculature in a perspective view of the top and side of the apparatus.
Figure 6:
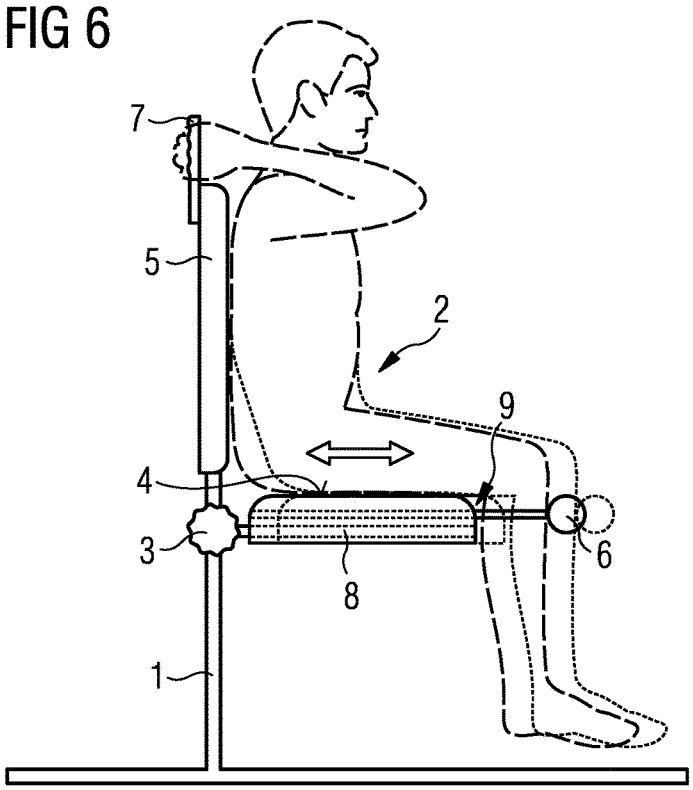
FIG. 6 shows the training apparatus of FIG. 1 with the user's upper body fixed in place against the back and simultaneous movement of the user's pelvis.
Figure 7:
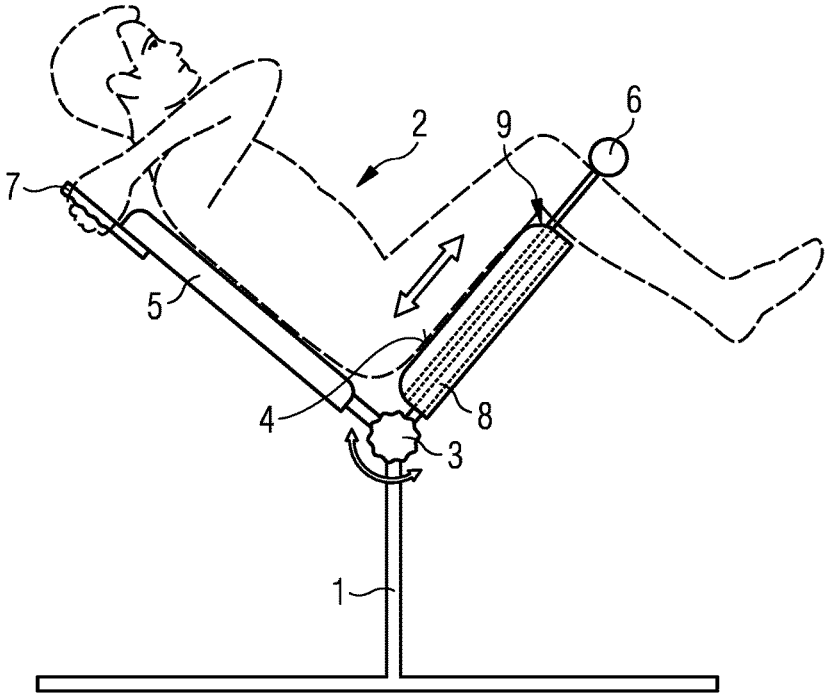
FIG. 7 shows the training apparatus of FIG. 1 with a tilting and locking in place of the swivel joint.
Figure 8:
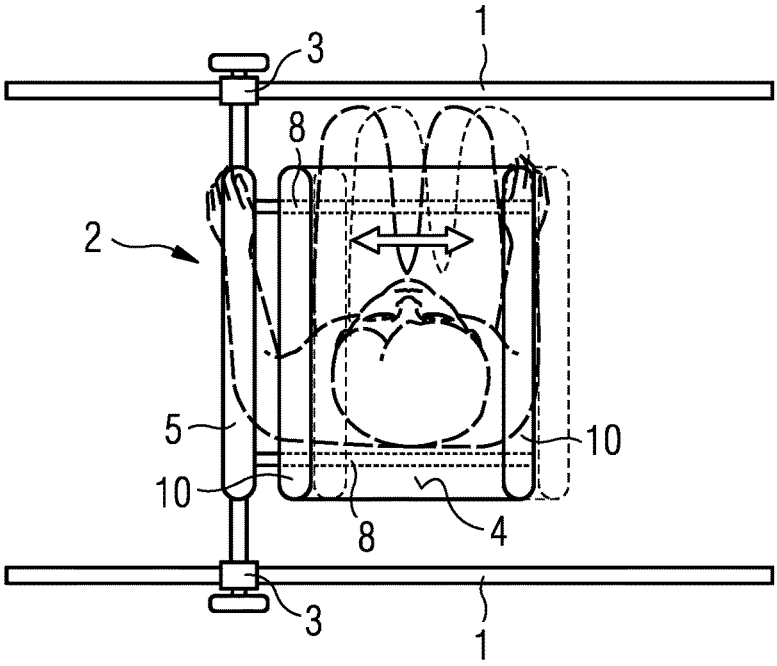
FIG. 8 shows the training apparatus of FIG. 3 with movement of the user.
Figure 9:
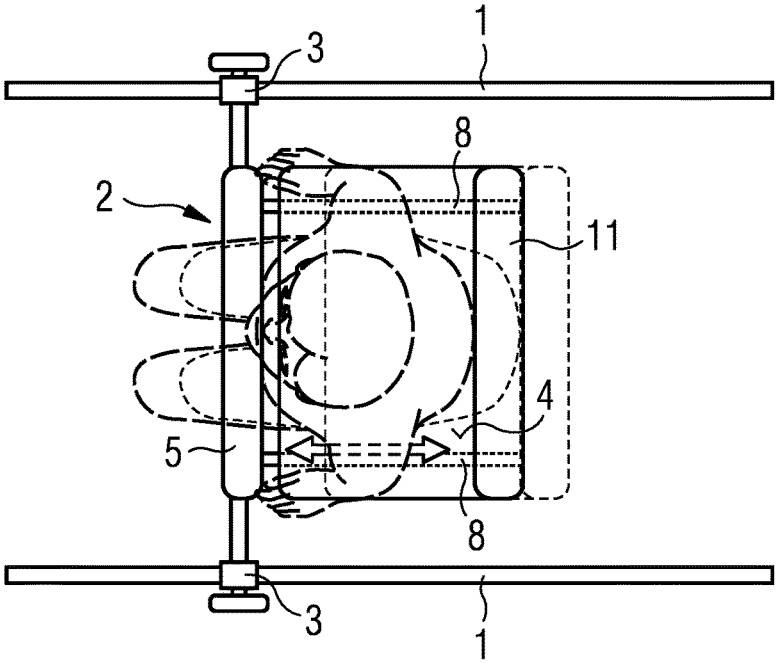
FIG. 9 shows the training apparatus of FIG. 4 with movement of the user.

FIG. 4 shows a training apparatus with a rest 5 for the front area of the upper body in an elementary top view.

In a further embodiment, the back 5 is a rest 5 for the front area of the upper body.

This rest 5 is located between the seat 4 and the second positioning device 7 here. The seat 4 has a rear seat bolster 11 as a first positioning device 6.

The invention claimed is:

1. A training apparatus for training the erector spinae, the inner oblique abdominal muscles, the outer oblique abdominal muscles, the straight abdominal muscle and the transverse abdominal muscles of the user comprising a stand;

a movable seat configured to allow the user to sit without contact with the floor and without support for the feet;

a back comprising a backrest;

a bolster for the user's pelvis coupled to the seat;

a handgrip on the back; and a guideway comprising at least one straight guide connected to the back, wherein the back is in a fixed and unmovable position relative to the stand, and wherein the seat is configured to move along the guideway toward and away from the back along a straight path, such that the pelvis of the user moves back and forth along the guideway while the upper body of the user is held in place against the back and neither the user's feet nor the user's legs support the upper body.

2. The training apparatus according to claim 1, wherein one or more lateral seat bolsters are coupled to the seat.

3. The training apparatus according to claim 1, wherein the seat is connected to the stand via a swivel joint and can be locked in place in various positions so that the seat can be tilted relative to the stand.

4. The training apparatus according to claim 1, further comprising a T-shaped positioning device.

5. The training apparatus according to claim 4, wherein the T-shaped positioning device has a bolster configured to support the knees or the lower legs of the user.

6. A training apparatus for training the erector spinae, the inner oblique abdominal muscles, the outer oblique abdominal muscles, the straight abdominal muscle and the transverse abdominal muscles of the user comprising a stand;

a movable seat configured to allow the user to sit without contact with the floor and without support for the feet;

a back comprising an armrest;

a bolster for the user's pelvis coupled to the seat; and a guideway comprising at least one straight guide connected to the back, wherein the armrest is in a fixed and unmovable position with respect to the stand, and wherein the seat is configured to move along the guideway toward and away from the back along a straight path, such that the pelvis of the user moves side to side, relative to the user, along the guideway while the upper body of the user is held in place against the armrest and neither the user's feet nor the user's legs support the upper body.

7. A training apparatus for training the erector spinae, the inner oblique abdominal muscles, the outer oblique abdominal muscles, the straight abdominal muscle and the transverse abdominal muscles of the user comprising a stand;

a movable seat configured to allow the user to sit without contact with the floor and without support for the feet;

a back comprising a rest for the front part of the user's upper body;

a bolster for the user's pelvis coupled to the seat;

and a guideway comprising at least one straight guide connected to the back, wherein the rest for the front part of the user's upper body is in a fixed and unmovable position with respect to the stand, and wherein the seat is configured to move along the guideway toward and away from the back along a straight path, such that the pelvis of the user moves back and forth along the guideway while the upper body of the user is held in place against the rest and neither the user's feet nor the user's legs support the upper body.

* * * * *